US006253590B1

(12) United States Patent
Lonero et al.

(10) Patent No.: US 6,253,590 B1
(45) Date of Patent: Jul. 3, 2001

(54) DEEP ROLLING TOOL MECHANISM WITH NOVEL PIN SUPPORTED CAGE DESIGN

(75) Inventors: Vincent J. Lonero, Bloomfield Hills; Shawn D. Luteran, Waterford, both of MI (US)

(73) Assignee: Lonero Engineering Company, Troy, MI (US)

( * ) Notice: Subject to any disclaimer, the term of this patent is extended or adjusted under 35 U.S.C. 154(b) by 0 days.

(21) Appl. No.: 09/558,251

(22) Filed: Apr. 25, 2000

(51) Int. Cl.[7] ..... B21H 7/18
(52) U.S. Cl. ..... 72/110; 72/107
(58) Field of Search ..... 72/107, 110; 29/6.01

(56) References Cited

U.S. PATENT DOCUMENTS 5,699,692 * 12/1997 Lonero et al. ..... 72/110
6,094,956 * 8/2000 Vodopyanov et al. ..... 72/110

* cited by examiner

*Primary Examiner*—Lowell A. Larson
(74) *Attorney, Agent, or Firm*—Dinnin & Dunn, P.C.

(57) ABSTRACT

An upper work tool mechanism for use in deep rolling operations and having a housing and a cover plate, as well as a cage system for operatively mounting the work rollers, with the cage being designed such that the cage and the cage retainer members have one or more pins associated therewith to uniquely support and strengthen the cage.

12 Claims, 3 Drawing Sheets

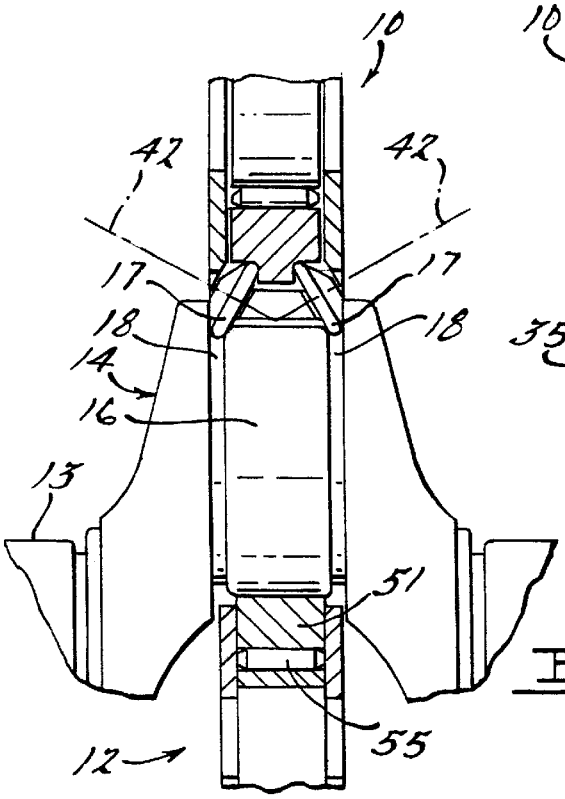
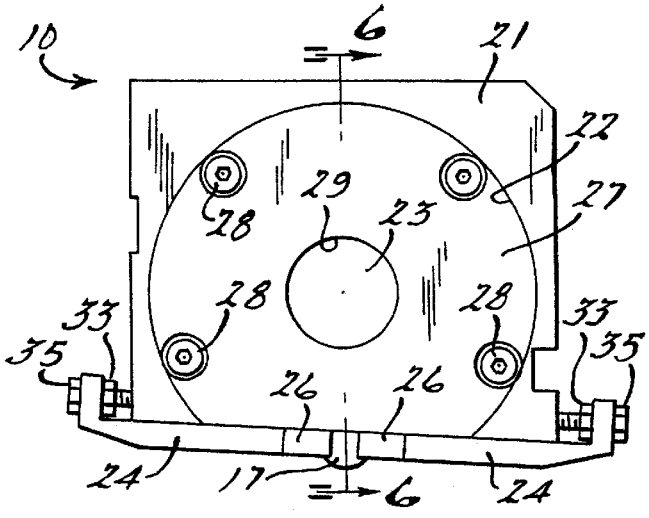
FIG. 1.
FIG. 2.
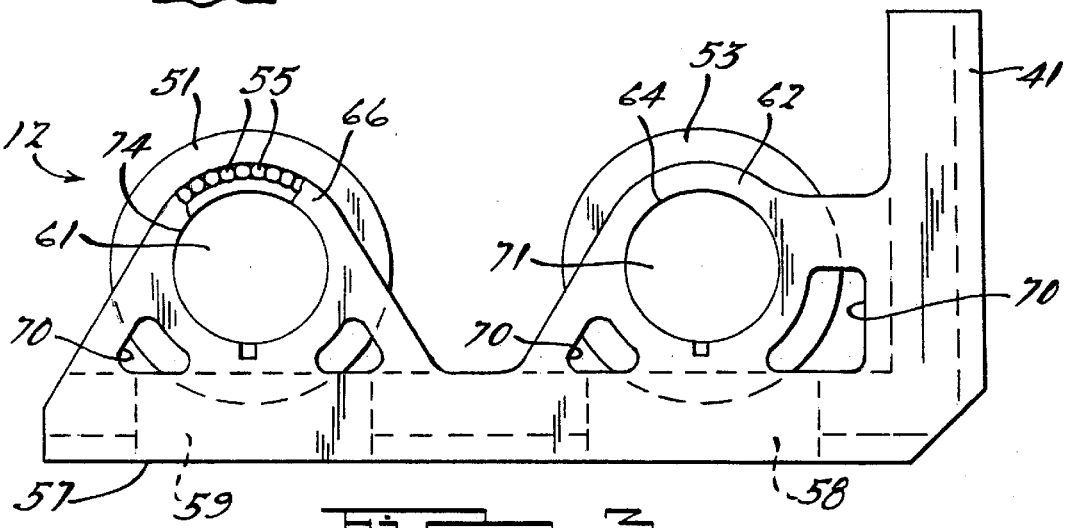
FIG. 3.
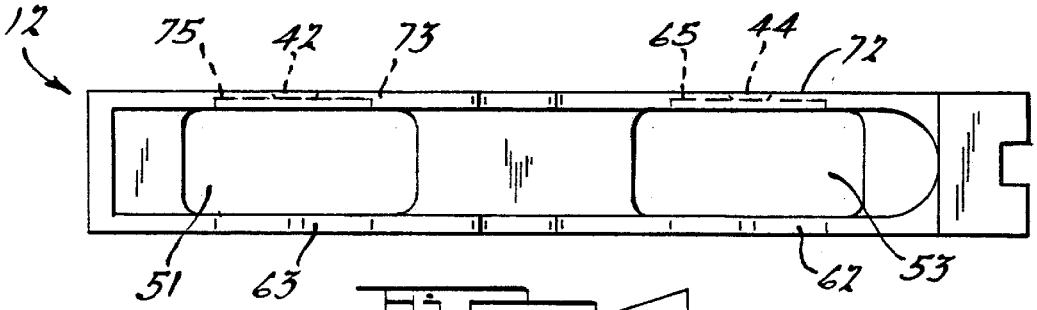
FIG. 4.

DEEP ROLLING TOOL MECHANISM WITH NOVEL PIN SUPPORTED CAGE DESIGN

BACKGROUND OF THE INVENTION

This invention broadly relates to deep rolling fillets of engine crankshafts or other annular areas of metallic work pieces subject to high stress loads. More particularly, this invention relates to a new tool mechanism for deep rolling machines, wherein the tool mechanism includes a new and unique cage and cage retainer design for holding the work rollers.

The state-of-the-art is indicated by the following cited references: Gottschalk, U.S. Pat. Nos. 5,495,738; Gottschalk, et al. 5,445,003; Bone, 5,493,761; Winkens, 5,138,859; Berstein, 4,561,276; and Ostertag, 4,947,668. The disclosures of Lonero, et al. U.S. Pat. Nos. 5,699,692 and Lonero, et al. 5,806,184 are hereby incorporated herein by reference.

Various machines and methods have been employed to strengthen and finish metal work pieces such as crankshafts and camshafts for internal combustion engines. In many modern automobiles, engines have been downsized for installation into small vehicles. Accordingly, with downsizing of automotive vehicles and their components for reducing weight and improving fuel efficiency, smaller engines and crankshafts are often used. To improve the fatigue strength and durability of these crankshafts, deep rolling of fillets and other circular joint areas is increasingly important. The fatigue strength and durability of crank pins and main bearing journals can be significantly increased by deep rolling compressive stresses into the middle of the annular fillets between the pin journals and adjacent counter weights or balancing webs.

In previously designed tool mechanisms for deep rolling machines the cage members which hold the working rollers during the deep rolling operation are subjected to wear and tear; and, also these cage members are subjected to damage or breaking during operation of the tool mechanism. Also, previously designed tool mechanisms for deep rolling possess tab members (on the cage retainers) which often were damaged, cracked or broken during usage of the tool mechanism.

Accordingly, one object of the present invention is to provide a novel design for a tool mechanism used in deep rolling operations wherein the cage structure for the tool mechanism is of a new and unique design.

Another object of the present invention is to provide a new and improved tool mechanism for deep rolling operations wherein the cage design for the tool includes the novel use of a supporting pin structure to greatly improve the strength and durability of the cage design and the cage retainer members.

Still another object of the invention is to provide a newly designed tool mechanism for deep rolling operations which has an improved and unique cage design for holding the work rollers, and which also is designed such that the tool mechanism can be cleaned in conventional ultrasonic cleaning systems without disassembly.

Other objects features and advantages of the present invention will become apparent from the subsequent description and the appended claims, taken in conjunction with the accompanying drawings (wherein like numerals indicate like elements).

BRIEF DESCRIPTION OF THE DRAWINGS

FIG. 1 is sectional view showing the upper and lower work roller tools engaging a journal of a crankshaft;

FIG. 2 is a side view of the upper work roller tool shown in FIG. 1;

FIG. 3 is a side view of the lower work tool including a cut-a-way view of one ridge thereof;

FIG. 4 is a top view of the work tool shown in FIG. 3;

SUMMARY OF THE INVENTION

Figure 5:
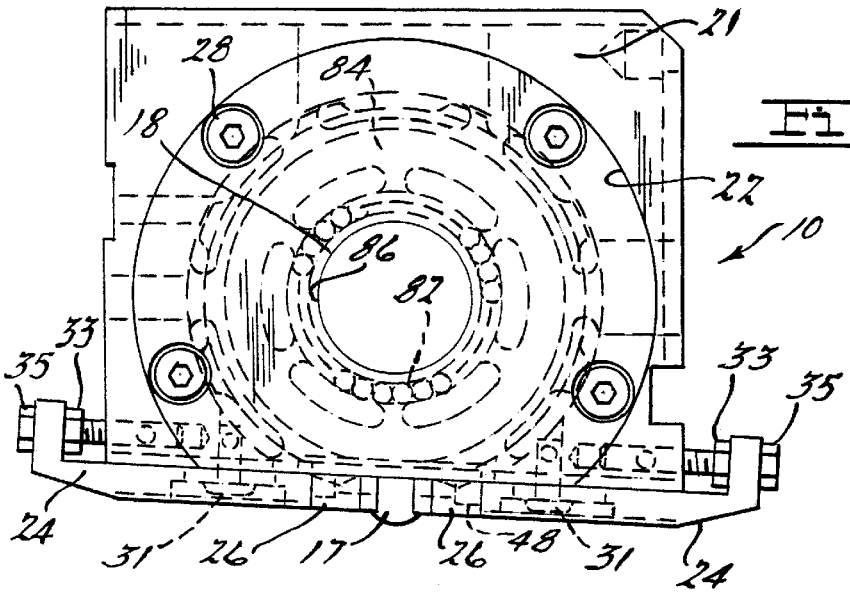
FIG. 5 is a partially cut-away view of the upper work roller tool shown in FIG. 2 to further illustrate the invention herein.

Briefly stated, this invention involves a tool mechanism for use in the deep rolling of a crankshaft product or like product, comprising: a housing having a side forming an annular opening, a cage formed at one end of said housing, work rollers operatively mounted in said cage and operatively inclined outward to physically engage a fillet of the product, at least one annular cover plate secured to said housing at said annular opening, at least one specially designed cage retainer member slidably positioned on said housing and engaging an outer side of said cage away from said rollers, and one or more pin members mounted within aligned apertures located on the outer side of the cage and an adjacent side of the cage retainer member, with the pin members acting to uniquely strengthen and support the cage structure.

DESCRIPTION OF THE PREFERRED EMBODIMENTS AND BEST MODE OF CARRYING OUT THE INVENTION

Referring now in greater detail to the drawings, FIG. 1 is a sectional view of an upper work roller tool 10, and a lower work roller tool 12, engaging and rolling the crankshaft 14 at a journal area 16 to form the laterally spaced annular fillets 18. By directing high forces to each work roller tool 10 and 12, high and concentrated rolling forces are translated to the work rollers 17. Upon engaging crankshaft 14 in journal area 16, the work rollers 17 of the upper work roller tool 10 form the laterally spaced annular fillets 18. This deep rolling process strengthens the journals 13, 16 of the crankshaft 14 to increase the life of the crankshaft during engine operation.

FIG. 2 is a side view of the upper work roller tool 10. This roller tool 10 comprises a rectangular main housing or body 21 that has been formed to provide an annular recess 22 that receives an annular cover plate 27. The cover plate 27 is secured to the main body 21 by threaded fasteners 28. The main body 21 and cover plate 27 have aligned enlarged recesses 29 to receive a cylindrical hub 23.

The roller tool 10 has a pair of L shaped cage retainer members 24, adjustably secured to the lower end of the main body 21 by opposing adjustable threaded fasteners 35. The retainer members 24 also utilize threaded fasteners 31 (see FIG. 5) to adjust and maintain the proper positioning of the retainer members 24. The fasteners 35 also utilize lock nuts 33 to lock fastener 35 in fixed position. The retainers 24 have inboard ends which are recessed to provide for engagement with and to give support for cage members 26, 26, which form the actual cage to support the two rollers 17, 17.

When the retainers 24 are secured to the main body 21, the cage members 26 support the work rollers 17 for floating rotation generally upwardly and outwardly to an inclined axis 42 (see FIG. 1) so that the working circumference 44 (see FIG. 6) of the work rollers 17 extend and engage the laterally spaced annular fillets 18 of the crankshaft journal 16 being rolled.

FIG. 3 illustrates a side view of the lower work tool 12 of the invention, comprising a main body formed by an L shaped member 41 with a longitudinal axis 57 integrally supporting two laterally spaced sides allowing for a one piece design of the lower work tool 12 as illustrated in FIGS. 1, 3 and 4. Each side is symmetrically aligned relative to the other side thereby comprising a pair of spaced ridges 62, 72 and 63, 73 with each ridge forming annular races 64, 74 and 65, 75. Two hubs 61, 71 are axially positioned between the sides and supported by oppositely aligned races, with said hubs secured to said ridges by flathead screws (not shown), and with said screws being positioned through tapered openings 42, 44 respectively. A pair of receiving rollers 51, 53 are rotatably supported by needle bearings 55 as illustrated in FIG. 3, with a partial cut-a-way view of ridge 66, and with said needle bearings 55 being supported by said hubs 61, 71.

The longitudinal axis 57 of said lower work tool 12 forms two rectangular openings 58, 59 as illustrated in FIG. 3, positioned beneath said hubs during the deep rolling process, and said openings are large enough to allow a smooth flow of lubricating fluid and debris to pass said receiving rollers 51, 53. Additionally, the ridges 62, 72, 63, 73 form a plurality of openings 70 leaving just enough structure for each ridge to adequately support said hubs 61, 71 during the deep rolling process. With this combination of openings or apertures 70, the bulk of the debris is able to effectively pass through the work tools and work piece, either when the tool 12 is in place or during cleaning.

Since the lower work tool 12 is routinely beneath the work piece during the deep rolling process, the bulk of the debris often collects around this tool, and consequently, may require disassembly for cleaning. When disassembly is required the one-piece open design permits easy assembly and disassembly. Also the openings or apertures 70 facilitate the cleaning of the lower work tool either when the lower work tool is still in position within the machining operation or when the machinery is disassembled for cleaning. Only the hubs 61, 71 and rollers 51, 53 are required to be removed and this is easily accomplished by simply removing the hubs and rollers from the open end of the tool 12. Therefore, when cleaning is necessary only a minimal amount of man hours is need to clean the tool and downtime for the tool is greatly diminished, thereby increasing productivity considerably. Also because of the presence of the openings or apertures 70, it is possible or feasible to clean the lower work tool when it is still in position in the rolling machine, simply by spraying or cleaning the lower work tool with a properly dispersed cleaning solvent etc.

Figure 6:
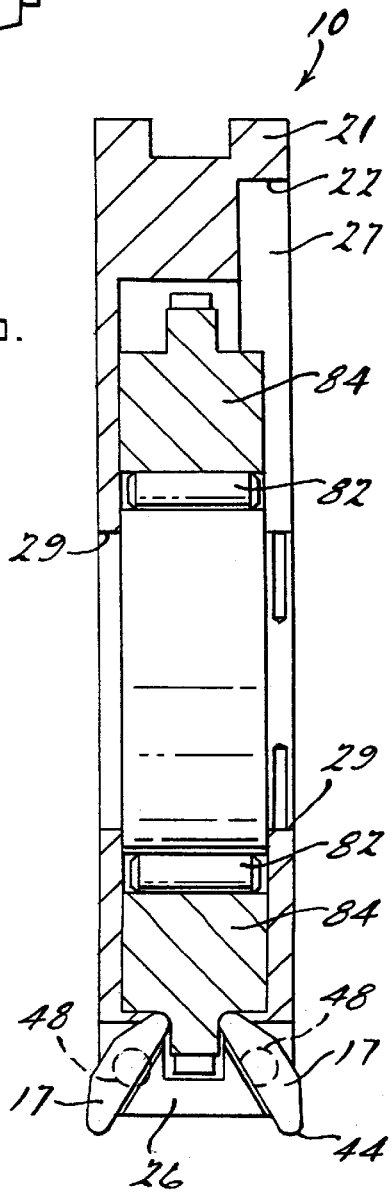
FIG. 6 is a cross-sectional view of the upper work tool taken along the sectional line 6—6 shown in FIG. 2 or FIG. 5.

The upper work roller tool 10 shown in FIGS. 5, 6 and 8–13 is now to be further described. FIG. 5 illustrates the upper work roller tool 10 of FIG. 2, but FIG. 5 shows a partial cross-section and phantom view to better illustrate certain portions of the invention. FIG. 6 is a cross-sectional view of FIG. 5 taken along the line 6—6 to illustrate the interior construction of the upper work roller tool mechanism. In FIGS. 5 and 6, as noted earlier, the upper work roller tool 10 is comprised of a rectangular main housing body 21 that has been formed to provide an annular recess 22 that receives an annular cover plate 27. The cover plate 27 is secured to the main body 21 by threaded fasteners 28. The main body 21 and cover plate 27 have aligned enlarged annular recesses 29 to receive cylindrical hub 23. The tool mechanism 10 also includes work rollers 17, two cage retainer members designated 24, and two cage members designated 26. As seen in FIGS. 5 and 6, the upper tool mechanism 10 also includes two dowels or pins designated 48 which extend from the cage retainer member 24 into the adjacent cage member 26. The purpose of the dowels or pins 48 is to uniquely support and strengthen the two cage members 26; and also to assist in properly locating the cage members 26 such that they will properly function in their purpose of supporting the two rollers 17 to carry out the deep rolling action. The tool mechanism 10 also includes threaded screws 28 which hold the cover plate in position and needle bearings 82 which support and enable rotational movement of the backup roll 84. The tool mechanism 10 further includes anti-rotation pin 86.

Figure 7:
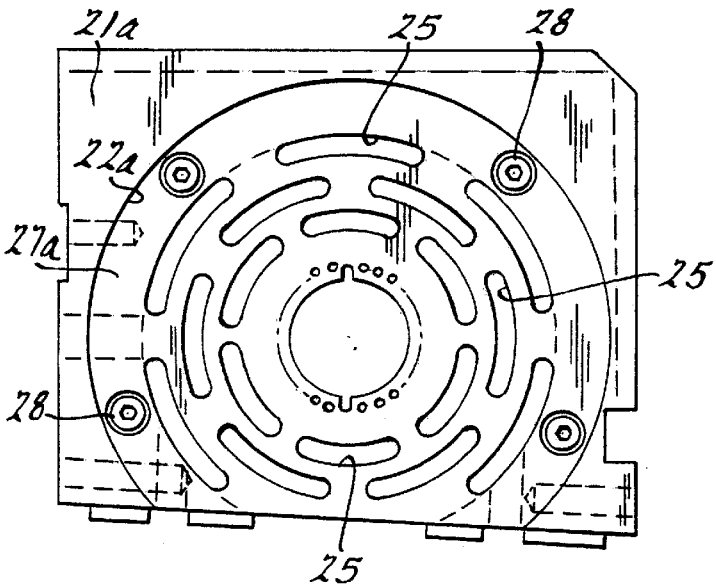
FIG. 7 is an alternate embodiment of the invention, and in general is a view of just the housing portion of FIG. 2, with numerous apertures positioned through the housing.

FIG. 7 shows another embodiment of the invention, where the housing body 21*a* and the cover plate 27*a* have numerous openings or apertures 25 positioned completely through both the housing and the cover plate, to thereby facilitate lubrication and cleaning of the tool mechanism.

Figure 8:
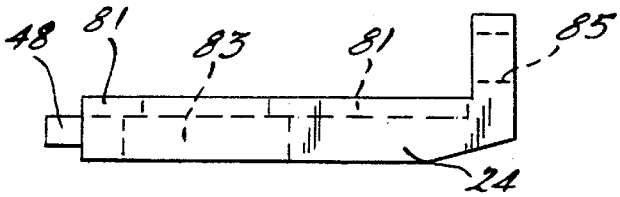
FIG. 8 is a side view of the cage retainer member shown in FIG. 2.
Figure 10:
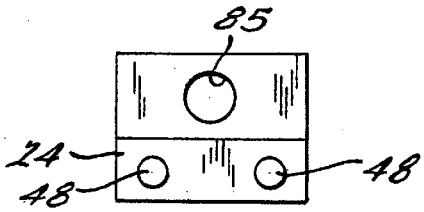
FIG. 10 is a side view of FIG. 9.
Figure 9:
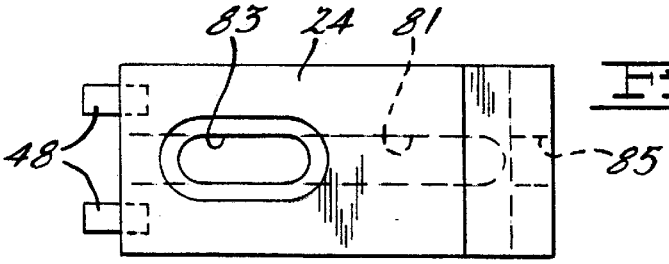
FIG. 9 is a bottom view of the cage retainer member of FIG. 8.

FIGS. 8–13 of the invention show the cage retainer members 24 and the cage members 26 (from FIG. 5) in more detail. The cage retainer 24 shown in FIGS. 8, 9 and 10 is comprised of a generally L-shaped member which has a lengthwise slot 81 positioned in a longitudinal direction along the cage retainer 24, with the slot formed to engage a corresponding ridge (not shown) on the bottom of the housing 21. There is also an oval shaped slot 83 formed in the cage retainer member 24, with this slot 83 acting to receive the threaded fastener 31 (FIG. 5), which when tightened acts to hold the cage retainer member 24 in position against the cage member 26 on the upper work tool 10. The cage retainer member 24 also contains an aperture 85 through which the threaded fastener 35 is positioned, with the fastener 35 being held in fixed position by the lock nut 33. The cage retainer 24, as noted above, also includes pin members 48 which uniquely engage with the receptive apertures 26 to greatly support and strengthen the entire cage structure.

Figure 11:
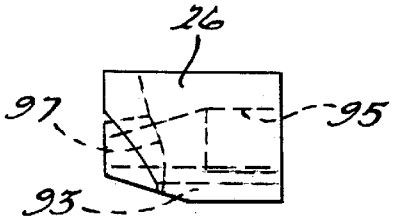
FIG. 11 is a view of the cage member from FIG. 2.
Figure 12:
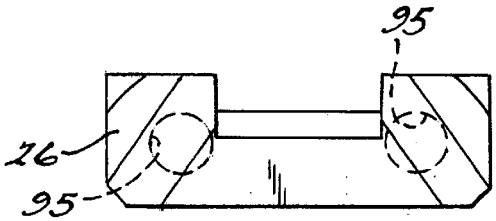
FIG. 12 is a side view of FIG. 11.
Figure 13:
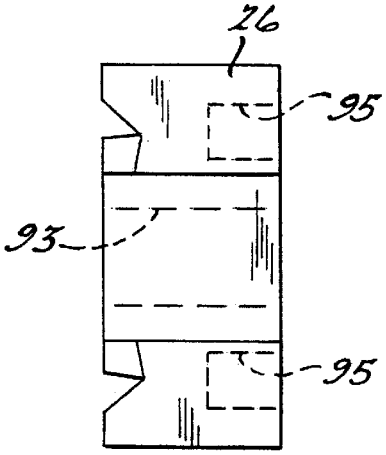
FIG. 13 is a bottom view of FIG. 11.

The two pin members 48, shown in FIG. 9, mate with and are received within the corresponding apertures designated 95 in FIGS. 11–13. The purpose and function of the pins 48 is to uniquely support and strengthen the cage retainer member 24 and cage member 26 when they are positioned and fixedly held on the upper work roller tool 10, through attachment to the housing 21 by the fasteners 31 and 35. It has been unexpectedly discovered that the usage of such pins, as discovered and disclosed herein, significantly strengthens and supports the overall structure of the cage which holds the work rollers 17 in position in a unique fashion. The curved area designated 97 (see FIG. 11) is the curved portion of the cage member 26 which supports and guides the work rollers 17 during their rotational or rolling movement for the deep rolling operation.

Figure 14:
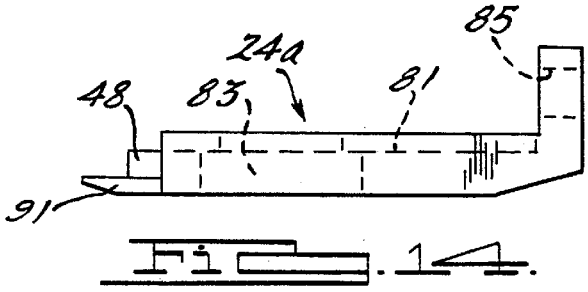
FIG. 14 is a view of a cage retainer member similar to that shown in FIG. 7, except in the FIG. 13 embodiment a tab member is also utilized.
Figure 15:
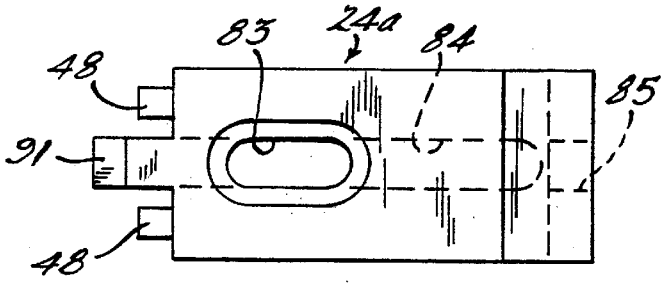
FIG. 15 is a bottom view of FIG. 14.

The cage retainer member 24*a* (see FIGS. 14–15) illustrates another embodiment of the invention. This embodiment also includes a tab member 91 which fits within the receptive slot 93 (shown with phantom lines) on the cage member 26 of FIGS. 11 and 13.

Thus, it is seen from the embodiment of the cage retainer member 24*a* (shown in FIGS. 14–15) that the concept of the invention is also workable with the presence of the tab member 91.

While it will be apparent that the preferred embodiments of the invention disclosed are well calculated to fulfill the benefits, objects, and/or advantages of the invention, it will be appreciated that the invention is susceptible to modification, variation and change without departing from the proper scope or fair meaning of the subjoined claims.

What is claimed is:

1. A tool mechanism for use in the deep rolling of a crankshaft product or like product, comprising:

a) a housing having a side forming an annular opening, b) a cage formed at one end of said housing, c) work rollers operatively mounted in said cage and operatively inclined outward to physically engage a fillet of said product, d) at least one annular cover plate secured to said housing at said annular opening, e) at least one cage retainer member slidably positioned on said housing and engaging an outer side of said cage away from said rollers, f) at least one pin member mounted within aligned apertures located on the outer side of said cage and an adjacent side of said cage retainer member, said pin member acting to structurally support the cage.

2. The tool mechanism of claim 1 wherein, said cage is formed of two opposing cage members, each having said outer side, and two cage retainer members each of which engage an outer side of said cage members, and there being a plurality of said pin members mounted in aligned apertures located between an adjacent cage member and cage retainer member.

3. The tool mechanism of claim 2 wherein, said housing contains a plurality of openings therein to facilitate lubrication and cleaning of the tool mechanism.

4. The tool mechanism of claim 3 wherein, said annular cover plate contains a plurality of openings therein.

5. The tool mechanism of claim 1 wherein, said housing contains a plurality of openings therein to facilitate lubrication and cleaning of the tool mechanism.

6. The tool mechanism of claim 5 wherein, said annular cover plate contains a plurality of openings therein.

7. A tool mechanism for use in the deep rolling of a crankshaft product or like product, comprising:

a) a housing having a side forming an annular opening, b) a cage formed at one end of said housing, c) work rollers operatively mounted in said cage and operatively inclined outward to physically engage a fillet of said product, d) at least one annular cover plate secured to said housing at said annular opening, e) at least one cage retainer member slidably positioned on said housing and engaging an outer side of said cage away from said rollers, f) at least one pin member mounted within aligned apertures located on the outer side of said cage and an adjacent side of said cage retainer member.

8. The tool mechanism of claim 7 wherein, said cage is formed of two opposing cage members, each having said outer side, and two cage retainer members each of which engage an outer side of said cage members, and there being a plurality of said pin members mounted in aligned apertures located between an adjacent cage member and cage retainer member.

9. The tool mechanism of claim 8 wherein, said housing contains a plurality of openings therein.

10. The tool mechanism of claim 9 wherein, said annular cover plate contains a plurality of openings therein.

11. The tool mechanism of claim 7 wherein, said housing contains a plurality of openings therein to facilitate lubrication and cleaning of the tool mechanism.

12. The tool mechanism of claim 11 wherein, said annular cover plate contains a plurality of openings therein.

* * * * *